US008594521B2

(12) United States Patent
Maruyama et al.

(10) Patent No.: US 8,594,521 B2
(45) Date of Patent: Nov. 26, 2013

(54) IMAGE FORMING APPARATUS

(75) Inventors: Tsuyoshi Maruyama, Nagoya (JP); Masahito Hamaya, Nagoya (JP); Katsumi Inukai, Iwakura (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 292 days.

(21) Appl. No.: 13/071,954

(22) Filed: Mar. 25, 2011

(65) Prior Publication Data

US 2012/0027436 A1 Feb. 2, 2012

(30) Foreign Application Priority Data

Jul. 29, 2010 (JP) ..... 2010-170937

(51) Int. Cl.
*G03G 15/02* (2006.01)

(52) U.S. Cl.
USPC ..... 399/31; 399/50; 399/168; 399/170; 399/197

(58) Field of Classification Search
USPC ..... 399/31, 50, 168, 170, 171, 179
See application file for complete search history.

(56) References Cited

U.S. PATENT DOCUMENTS

| | | | | |
|---|---|---|---|---|
| 5,159,388 | A * | 10/1992 | Yoshiyama et al. | 399/26 |
| 5,572,295 | A | 11/1996 | Sakagami et al. | |
| 7,813,658 | B2 * | 10/2010 | Hamaya et al. | 399/31 |
| 2001/0010768 | A1 * | 8/2001 | Furuya et al. | 399/296 |
| 2008/0247782 | A1 * | 10/2008 | Sato et al. | 399/171 |
| 2009/0052915 | A1 | 2/2009 | Claflin, Jr. et al. | |
| 2010/0080593 | A1 * | 4/2010 | Inukai et al. | 399/50 |
| 2010/0247126 | A1 * | 9/2010 | Naganawa | 399/50 |
| 2011/0246107 | A1 * | 10/2011 | Burry et al. | 702/64 |

FOREIGN PATENT DOCUMENTS

| | | |
|---|---|---|
| JP | 02-130571 | 5/1990 |
| JP | 03-089264 | 4/1991 |
| JP | 03-142483 | 6/1991 |
| JP | 05-323773 | 12/1993 |
| JP | 07-244420 | 9/1995 |
| JP | 11-133765 | 5/1999 |
| JP | 2007-086229 | 4/2007 |
| JP | 2010-102289 | 5/2010 |

OTHER PUBLICATIONS

Notification of Reason for Refusal for corresponding Japanese Patent Application 2010-170937 dated May 29, 2012.
Extended European search report for application No. 11159866.0 mailed Nov. 14, 2011.

* cited by examiner

*Primary Examiner* — David Gray
*Assistant Examiner* — Francis Gray
(74) *Attorney, Agent, or Firm* — Banner & Witcoff, Ltd.

(57) ABSTRACT

An image forming apparatus including: a plurality of photosensitive drums; a plurality of scorotron chargers provided for the plurality of photosensitive drums, respectively, a voltage application circuit commonly connected to the plurality of scorotron chargers, a plurality of wires provided for the plurality of scorotron chargers, respectively; a plurality of grid electrodes provided for the plurality of scorotron chargers, respectively; at least one of current detecting units provided for at least one of the plurality of grid electrodes, respectively, and at least one of the current detecting units detecting grid current which flows into at least one of the grid electrodes, respectively; and a control device configured to control the voltage application circuit such that at least one of the grid currents detected by at least one of the current detecting units become equal to or higher than a reference value.

12 Claims, 12 Drawing Sheets

IMAGE FORMING APPARATUS

CROSS REFERENCE TO RELATED APPLICATION

The present application claims priority from Japanese Patent Application No. 2010-170937, which was filed on Jul. 29, 2010, the disclosure of which is herein incorporated by reference in its entirety.

TECHNICAL FIELD

Apparatuses and devices consistent with the present invention relate to an image forming apparatus.

BACKGROUND

In a multicolor image forming apparatus, such as a color laser printer, a charger is provided for every process cartridge corresponding to each developer color (yellow, magenta, cyan, and black). In this type of image forming apparatus, the following Patent Document 1 discloses that a reduction in the number of parts and miniaturization of the apparatus are achieved by making common a high-voltage power supply unit (voltage application circuit) which applies high voltages to the individual chargers.

RELATED ART DOCUMENT

Patent Document

[Patent Document 1] JP-H03-142483-A

SUMMARY

In a case where the high-voltage power supply unit is made common as described above, the voltage levels to be applied to the individual chargers are no longer adjusted separately. On the other hand, contamination of wires provided in the individual chargers does not become necessarily uniform. Therefore, in a case where the high-voltage power supply unit is made common, variation occurs in the amounts of electric discharge of the individual chargers. If variation occurs in the amounts of electric discharge of the individual chargers, there is a possibility that the charging amount of a photosensitive drum may fall below a target value, and image quality may deteriorate.

The invention has been completed on the basis of the above circumstances, and the object there is to suppress deterioration of image quality in an image forming apparatus in which a voltage application circuit is made common.

According to a first illustrative aspect of the present invention, there is provided an image forming apparatus comprising: a plurality of photosensitive drums; a plurality of scorotron chargers which are provided for the plurality of photosensitive drums, respectively, the plurality of scorotron chargers charging the photosensitive drums, respectively; a voltage application circuit that is commonly connected to the plurality of scorotron chargers, the voltage application circuit applying voltages to the plurality of scorotron chargers; a plurality of wires which are provided for the plurality of scorotron chargers, respectively; a plurality of grid electrodes which are provided for the plurality of scorotron chargers, respectively; at least one of current detecting units which are provided for at least one of the plurality of grid electrodes, respectively, and at least one of the current detecting units detecting grid current which flows into at least one of the grid electrodes, respectively; and a control device that is configured to control the voltage application circuit such that at least one of the grid currents detected by at least one of the current detecting units become equal to or higher than a reference value.

An electric discharge current and a grid current which flow into a photosensitive drum from the wire of a charger are generally proportional to each other. According to the configuration of the invention, the grid current of a grid where a current detecting unit is provided is controlled to be equal to or higher than the reference value. Therefore, in a charger in which the grid current is controlled to be equal to or higher than the reference value, an electric discharge current which flows into a photosensitive drum from a wire becomes equal to or higher than a target level. Accordingly, the charging amount of the photosensitive drum does not run short, and the image quality does not deteriorate.

According to a second illustrative aspect of the present invention, in addition to the first aspect, a plurality of the current detecting units are provided for the plurality of grid electrodes, respectively, the plurality of the current detecting units performing detections of the grid currents, respectively, and wherein the control device discriminates a minimum current value from the detected grid currents, and controls the voltage application circuit such that a grid current of the minimum current value becomes a constant current which is equal to or higher than the reference value.

According to the configuration of the invention, the constant current control is performed with the grid current of the minimum current value being a current value which is equal to or higher than the reference value. Accordingly, all grid currents of all the chargers become equal to or higher than the reference value, and the charging amounts of all the photosensitive drums can be made equal to or higher than a target level. Therefore, the image quality does not deteriorate.

According to a third illustrative aspect of the present invention, in addition to the second aspect, the control device performs the processing of discriminating the minimum current value from the grid currents for every predetermined number of printing sheets, and controls the voltage application circuit such that the grid current discriminated to have the minimum current value becomes the constant current which is equal to or higher than the reference value.

According to the configuration of this invention, the minimum current value is discriminated in comparison with the grid current of each grid electrode for every predetermined number of printing sheets. Therefore, even if the tendency to contamination of the wire of each charger has changed, it is possible to control the grid current of a charger in which contamination of the wire is severest so as to be equal to or higher than the reference value.

According to a fourth illustrative aspect of the present invention, in addition the second aspect or the third aspect, a voltage detecting circuit that detects an output voltage of the voltage application circuit to be applied to the scorotron chargers, wherein when the output voltage detected in the voltage detecting circuit has exceeded an upper limit, the control device executes a processing of notifying wire cleaning which prompts cleaning of the wires.

According to the configuration of the invention, wire cleaning is notified when the voltage applied to a charger exceeds an upper limit. Therefore, the charging voltage of a charger does not rise beyond the upper limit, and abnormal electrical discharge of a wire can be prevented.

According to a fifth illustrative aspect of the present invention, in addition to anyone of the second aspect to the fourth aspect, the control device executes a processing of notifying an abnormality when the grid current of the minimum current value cannot be controlled to the constant current which is equal to or higher than the reference value.

According to a sixth illustrative aspect of the present invention, in addition to anyone of the second aspect to the fifth aspect, the control device executes a processing of notifying wire cleaning which prompts cleaning of the wires when a current difference between two different grid currents become equal to or higher than a predetermined value.

According to another aspect of the present invention, there is provided an image forming apparatus comprising: a photosensitive drum; a plurality of scorotron chargers which are provided for the photosensitive drum, the plurality of scorotron chargers charging the photosensitive drum; a voltage application circuit that is commonly connected to the plurality of scorotron chargers, the voltage application circuit applying voltages to the plurality of scorotron chargers; a plurality of wires which are provided for the plurality of scorotron chargers, respectively; a plurality of grid electrodes which are provided for the plurality of scorotron chargers, respectively; at least one of current detecting units which are provided for at least one of the plurality of grid electrodes, respectively, and at least one of the current detecting units detecting grid current which flows into at least one of the grid electrodes, respectively; and a control device that is configured to control the voltage application circuit such that at least one of the grid currents detected by at least one of the current detecting units become equal to or higher than a reference value.

According to the image forming apparatus of the invention, deterioration of image quality can be suppressed in the image forming apparatus in which the voltage application circuit is made common.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION

Embodiment 1

Embodiment 1 of the invention will be described with reference to FIGS. 1 to 6.

1. Entire Configuration of Printer

Figure 1:
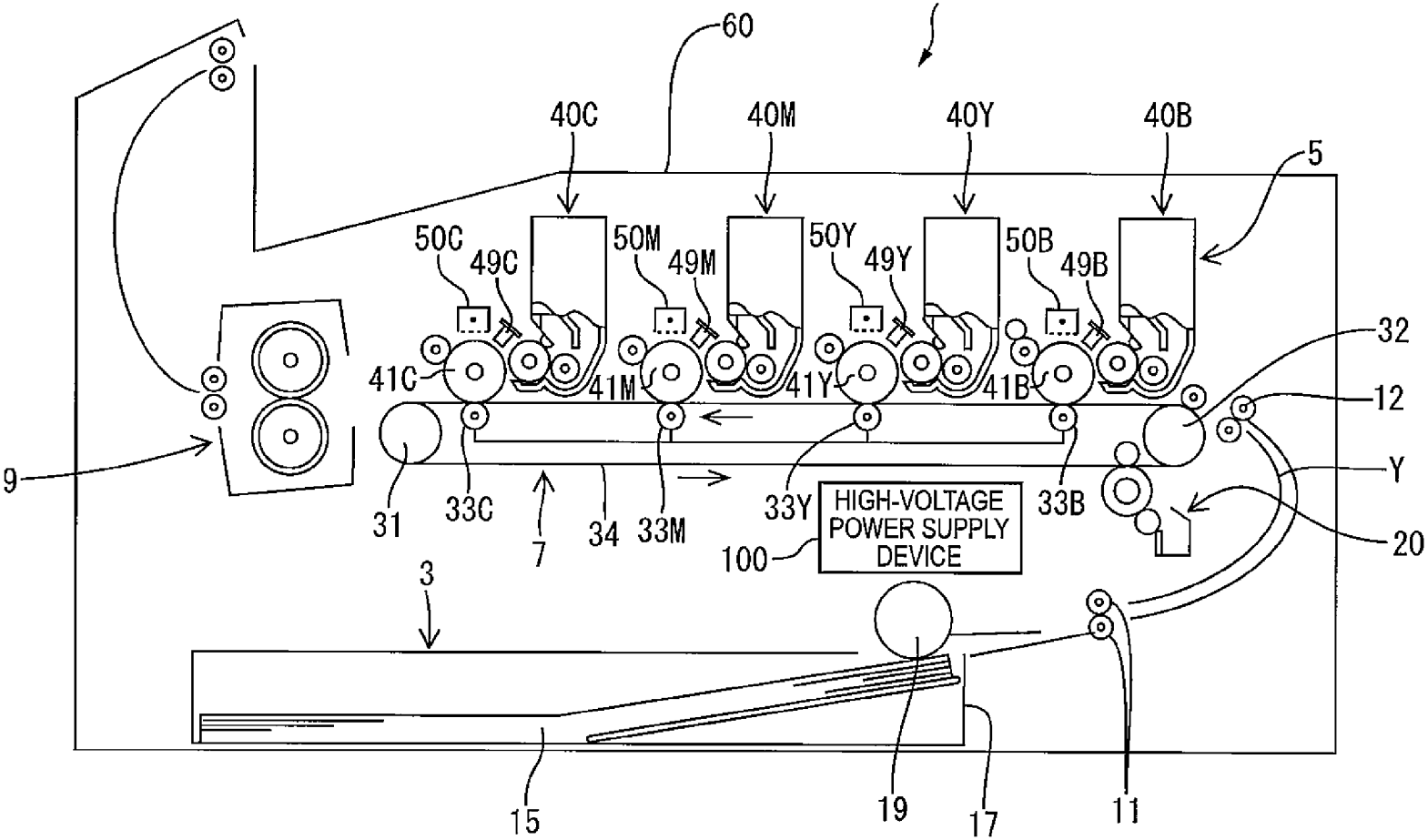
FIG. 1 is a schematic sectional view showing the internal configuration of a printer related to Embodiment 1 of the invention.

FIG. 1 is a schematic sectional view showing the internal configuration of a printer 1 of the present embodiment. In the following description, as for individual constituent elements, suffixes of B (black), Y (yellow), M (magenta), and C (cyan) are given to reference numerals of individual parts in a case where a distinction for each color is required, and the suffixes are omitted in a case where the distinction is not required.

As shown in FIG. 1, the printer 1 includes a paper feed unit 3, an image forming unit 5, a transport mechanism 7, a fixing unit 9, a belt cleaning mechanism 20, and a high-voltage power supply device 100. The paper feed unit 3 is provided at a lowermost portion of the printer 1, and includes a tray 17 which stores sheets (paper, OHP sheets, or the like) 15, and a pickup roller 19. The sheets 15 stored in the tray 17 are taken out one by one by the pickup roller 19, and are sent to the transport mechanism 7 via a transport roller 11 and a registration roller 12.

The transport mechanism 7 conveys the sheets 15, and is installed above the paper feed unit 3 within the printer 1. The transport mechanism 7 includes a driving roller 31, a driven roller 32, and a belt 34, and the belt 34 is stretched between the driving roller 31 and the driven roller 32. When the driving roller 31 turns, the surface of the belt 34 which faces the photosensitive drums 41B, 41Y, 41M, and 41C moves leftward from the right in FIG. 1. Thereby, a sheet 15 sent from the registration roller 12 is conveyed to under the image forming unit 5.

Additionally, four transfer rollers 33B, 33Y, 33M and 33C are provided at the belt 34 so as to correspond to the four photosensitive drums 41B, 41Y, 41M, and 41C. The individual transfer rollers 33 are arranged at positions where the individual transfer rollers face the individual photosensitive drums 41B, 41Y, 41M, and 41C while pinching the belt 34 therebetween.

The image forming unit 5 includes the four process units 40B, 40Y, 40M, and 40C and four exposure units 49B, 49Y, 49M, and 49C. The individual process units 40B, 40Y, 40M, and 40C are arranged in one row in the transport direction (right-and-left direction FIG. 1) of the sheets 15.

The individual process units 40 have the same structure, and include the photosensitive drums 41B, 41Y, 41M, and 41C for individual colors, toner cases 43 for individual toners which store individual color toners (for example, positively charged nonmagnetic monocomponent toners), developing rollers 45, and chargers 50B, 50Y, 50M, and 50C.

As for each of the photosensitive drums 41B, 41Y, 41M, and 41C, a positively charged photosensitive layer is formed on, for example, a base made of aluminum, and, the base made of aluminum is grounded to the ground of the printer 1.

The developing roller 45 is arranged to face a supply roller 46 in a lower portion of a toner case 43, and fulfills functions to frictionally charge a toner to a positive polarity by the friction accompanying the rotation when the toner passes between the developing roller and the supply roller, and to supply the toner as a uniform thin layer to the photosensitive drum 41B, 41Y, or 41M and 41C.

Figure 2:
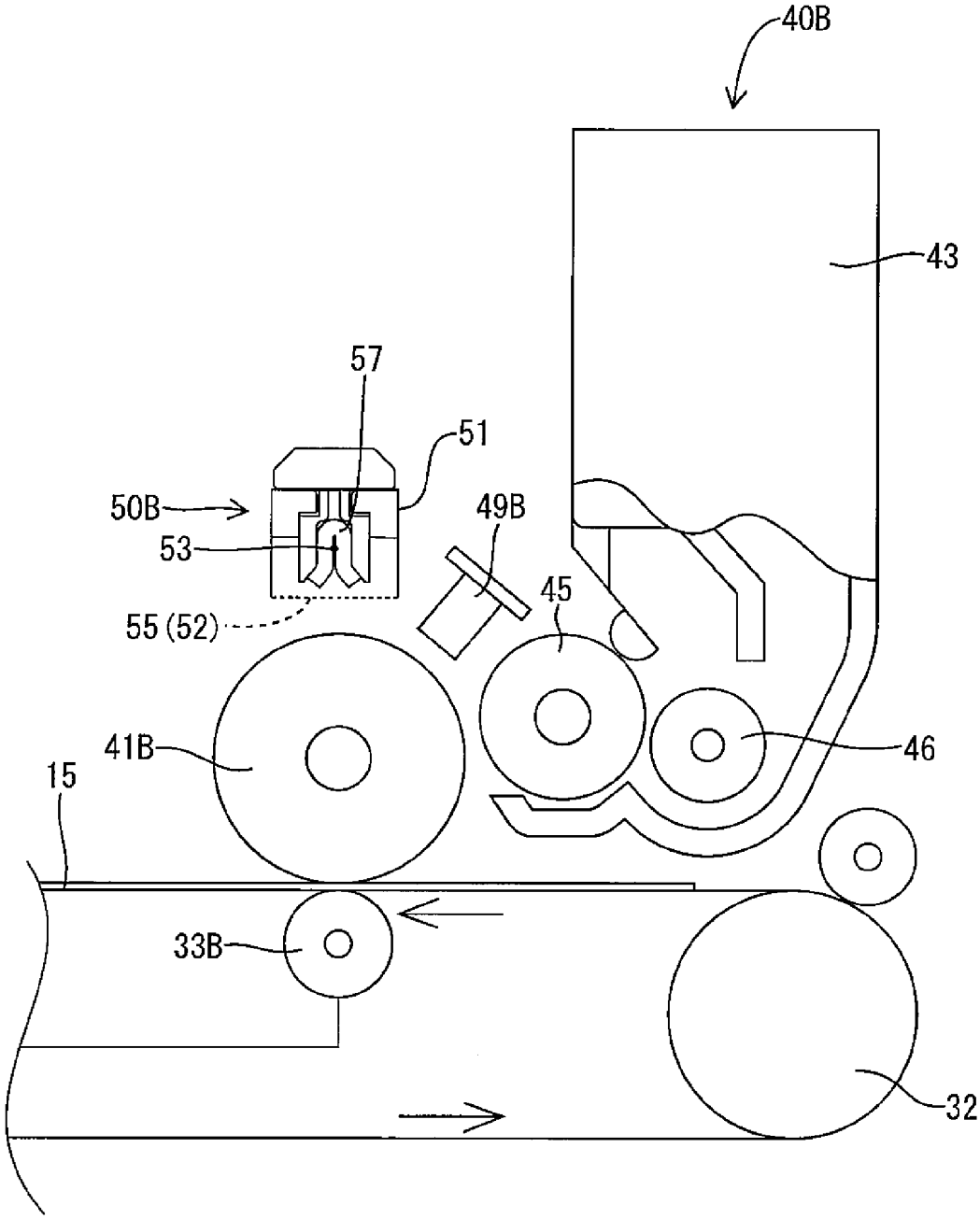
FIG. 2 is a view schematically showing the structure of a process unit.
Figure 3:
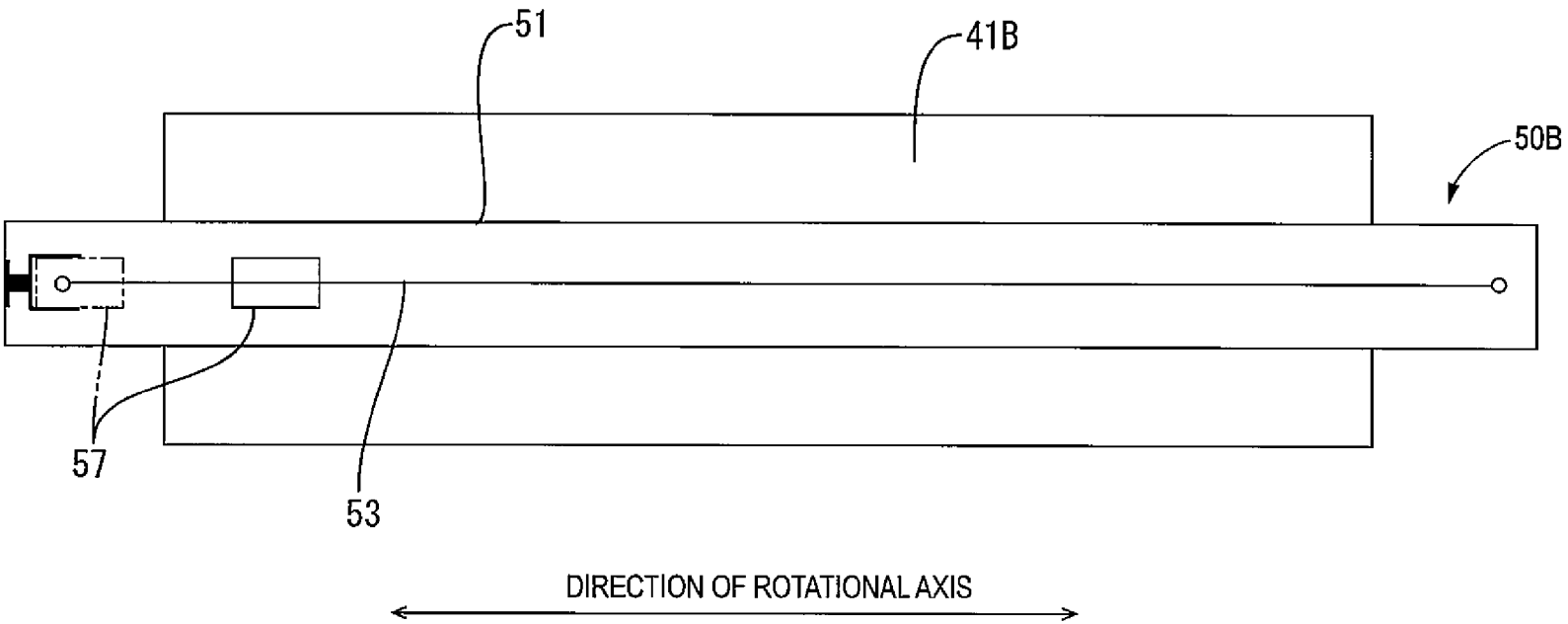
FIG. 3 is a view schematically showing the structure of a charger.

Each of the chargers 50B, 50Y, 50M, and 50C is a scorotron type charger, and as shown in FIGS. 2 and 3, has a shielding case 51, a wire 53, and a metallic grid electrode 55. The shielding case 51 has a prismatic shape which is long in the direction of a rotational axis of the photosensitive drum 41. The face of the shielding case 51 which faces the photosensitive drum 41 is opened as an electric discharge port 52.

The wire 53 is made of, for example, a tungsten wire. The wire 53 is stretched in the direction of the rotational axis (right-and-left direction of FIG. 3) within the shielding case 51, and has a high voltage applied thereto by a voltage application circuit 200 which will be described below. By the application of a high voltage, the wire 53 causes corona discharge within the shielding case 51. Also, as the ions generated by the corona discharge flow toward the surface of the photosensitive drum 41 from the electric discharge port 52, the surface of the photosensitive drum 41 is uniformly charged to positive polarity.

Also, a plate-shaped grid electrode 55 having a slit or a through hole is attached to the electric discharge port 52 of the shielding case 51. By applying a voltage to the grid electrode 55 and controlling the applied voltage, it is possible to control the charging voltage of the photosensitive drum 41.

Additionally, a wire cleaner 57 is provided at the chargers 50B, 50Y, 50M, and 50C. The wire cleaner 57 is configured so as to be able to oscillate along the wire 53. As an operator reciprocates the wire cleaner 57 along the wire 53, stains on the wire 53 can be eliminated.

Figure 6:
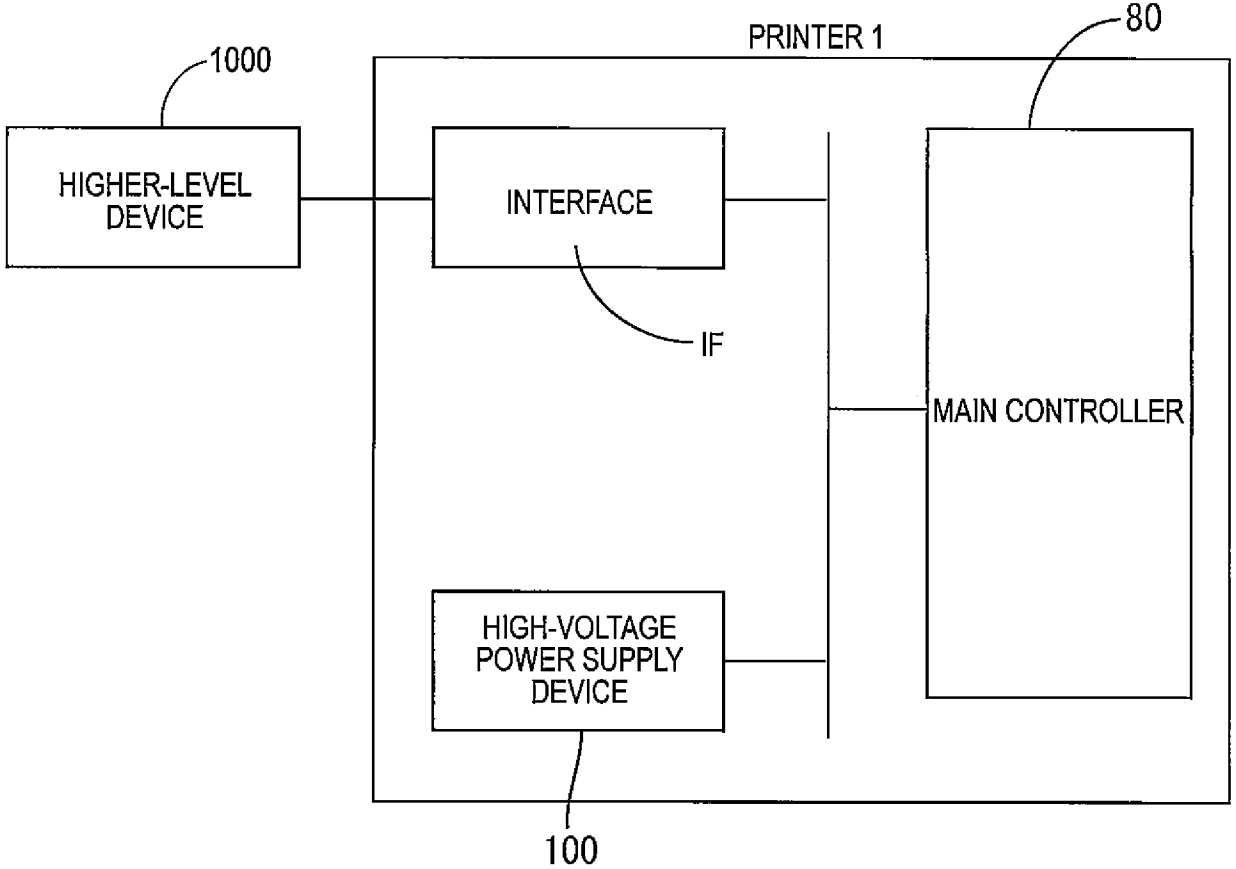
FIG. 6 is a block diagram showing the electrical configuration of a printer.

Each of the exposure units 49B, 49Y, 49M, and 49C has, for example, a plurality of light emitting elements (for example, LEDs) which is arranged in one row along the direction of the rotational axis of the photosensitive drum 41B, 41Y, 41M, or 41C, and fulfills a function of emitting light according to the image data input from the outside, thereby forming an electrostatic latent image on the surface of each of the photosensitive drums 41B, 41Y, 41M, and 41C. As shown in FIG. 6, the printer 1 has a main controller 80, the high-voltage power supply device 100 and an interface IF. The main controller 80 integrally controls the overall printer 1. The high-voltage power supply device 100 applies a high voltage to the chargers 50 and the transfer rollers 33 etc. The interface IF receives printing data output from the higher-level device 1000 such as a host computer or a scanner device.

Describing a series of image forming processing by the printer 1 configured as described above, the printer 1 starts print processing when the printing data is received. Thereby, the surface of each of the photosensitive drums 41B, 41Y, 41M, and 41C is positively charged uniformly by each of the chargers 50B, 50Y, 50M, and 50C with the rotation of the photosensitive drum. Also, light is irradiated toward each of the photosensitive drums 41B, 41Y, 41M, and 41C from each exposure unit 49. Thereby, a predetermined electrostatic latent image according to the printing data is formed on the surface of each of the photosensitive drums 41B, 41Y, 41M, and 41C, i.e., potential decreases at the portion of the surface of each of the photosensitive drums 41B, 41Y, 41M, and 41C which is positively charged uniformly and onto which light is irradiated according to the printing data.

Next, the toner which is carried on the developing roller 45 and positively charged is supplied to the electrostatic latent image, which has been formed on the surface of each of the photosensitive drums 41B, 41Y, 41M, and 41C, by the rotation of the developing roller 45. Thereby, the electrostatic latent images of the individual photosensitive drums 41B, 41Y, 41M, and 41C are formed as visual images, and toner images by reversal development are carried on the surfaces of the individual photosensitive drums 41B, 41Y, 41M, and 41C.

Additionally, the processing of transporting the sheets 15 is performed again in parallel with the above-described processing for forming a toner image. That is, the sheets 15 are delivered one by one to a paper transport path Y from the tray 17 by the turning of the pickup roller 19. A sheet 15 delivered to the paper transport path Y is carried to a transfer position (a point where the photosensitive drum 41 and the transfer roller 33 pinch the belt 34), by the transport roller 11 and the belt 34.

Then, when passing through this transfer position, individual color toner images (developer images) carried on the surfaces of the individual photosensitive drums 41 are sequentially and overlappingly transferred to the surface of the sheet 15 by transfer biases applied to the individual transfer rollers 33. In this way, the color toner images (developer images) are formed on the sheet 15. Then, when passing through the fixing unit 9 provided behind the belt 34, the transferred toner images (developer images) are thermally fixed, and the sheet 15 is ejected onto a sheet discharging tray 60.

2. Configuration of High-Voltage Power Supply Device 100

Figure 4:
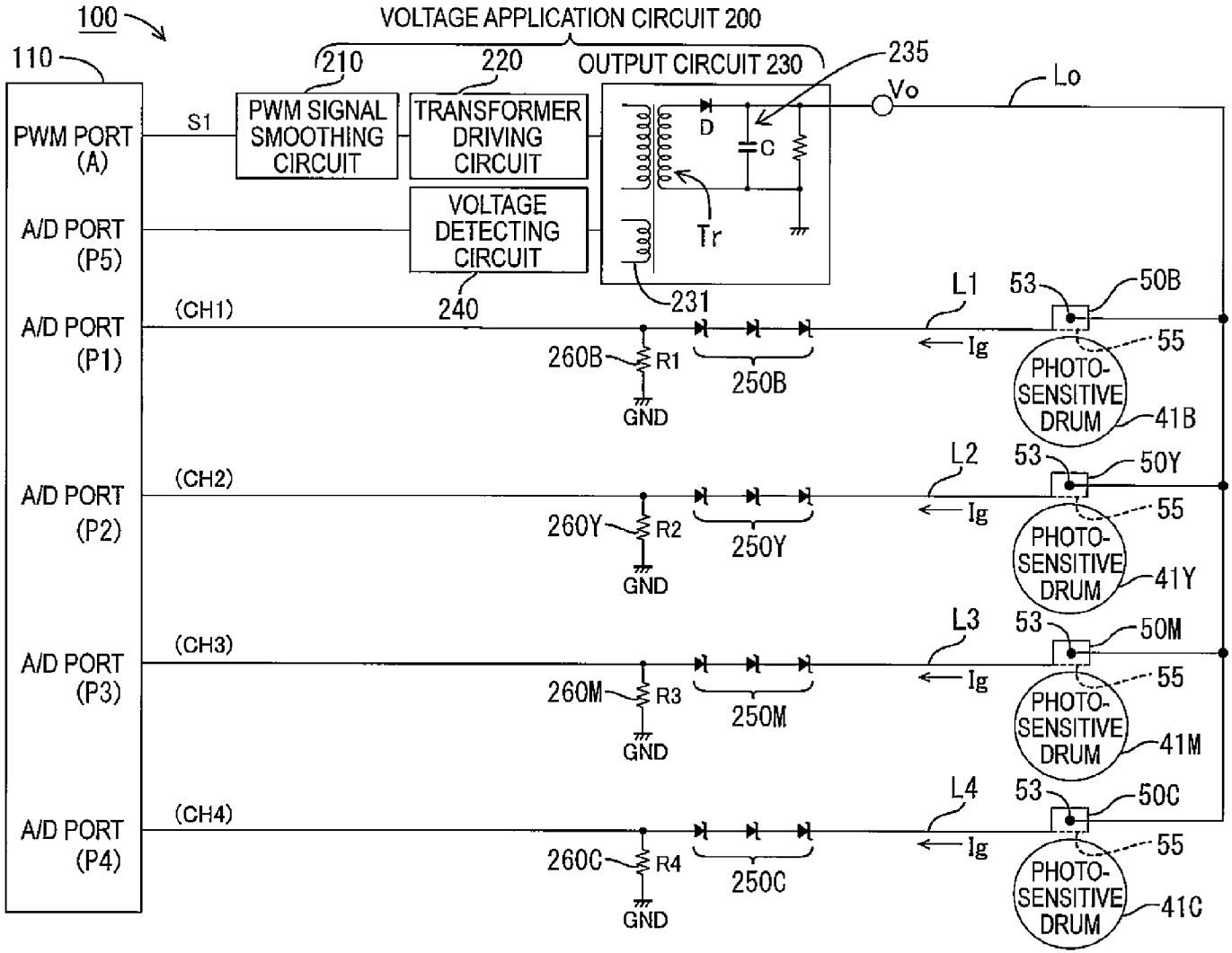
FIG. 4 is a block diagram showing the electrical configuration of a high-voltage power supply device.

The high-voltage power supply device 100, as shown in FIG. 4, includes a voltage application circuit 200, constant-voltage circuits 250B, 250Y, 250M, and 250C, current detecting units 260B, 260Y, 260M, and 260C, and a control device 110. In addition, the high-voltage power supply device 100 further includes a voltage application circuit that is configured to apply a high voltage to a load (circuit etc. . . . ) except for the transfer roller 33 and the charger 50, however, an explanation and figure related to this voltage application circuit is omitted.

The voltage application circuit 200 includes a PWM signal smoothing circuit 210, a transformer driving circuit 220, an output circuit 230, and a voltage detecting circuit 240, and fulfills a function to apply a high voltage of about 6 kV to 7 kV to each charger 50. The PWM signal smoothing circuit 210 smoothes a PWM signal S1 output from a PWM port A of the control device 110, and outputs the signal to the transformer driving circuit 220. The transformer driving circuit 220 is constituted by an amplifying element, such as a transistor, and applies a primary voltage at the level according to the duty ratio of the PWM signal S1 to primary winding of a transformer Tr.

The output circuit 230 is constituted by a booster circuit composed of the transformer Tr, and a smoothing circuit 235 composed of a diode D and a capacitor C, and boosts the primary voltage input from the transformer driving circuit 220, and then rectifies and outputs the boosted voltage. Then, wires 53 of the individual chargers 50B, 50Y, 50M, and 50C are commonly connected to an output line Lo of the output circuit 230. Thereby, the output voltage Vo of the output circuit 230 is applied to the wires 53 of the individual chargers 50B, 50Y, 50M, and 50C.

Additionally, the transformer Tr of the output circuit 230 is provided with auxiliary winding 231. A voltage at the level according to the secondary voltage of the transformer Tr is generated at the auxiliary winding 231.

The voltage detecting circuit 240 detects the voltage generated in the auxiliary winding 231, and inputs the voltage to an A/D port P5 of the control device 110. Thereby, the data of the secondary voltage of the transformer Tr is fetched into the control device 110.

Additionally, as shown in FIG. 4, in the present embodiment, connecting lines L1 to L4 are provided at the chargers 50B, 50Y, 50M and 50C, respectively, and individual ground the grid electrodes 55 of the individual chargers 50B, 50Y, 50M, and 50C are connected to ground GND through the individual connecting lines L1 to L4. Also, the constant-voltage circuit 250 and the current detecting unit 260 are provided on each of the connecting lines L1 to L4.

The constant-voltage circuits 250B, 250Y, 250M, and 250C are constituted by three zener diodes which are connected in series, and the voltage of the grid electrode 55 of each of the chargers 50B, 50Y, 50M, and 50C is brought into a constant voltage of a voltage value (for example, 250 V×3) obtained by multiplying the breakdown voltage per one zener diode by three times.

The individual current detecting units 260B, 260Y, 260M, and 260Y are composed of individual resistors R1 to R4 which are connected in series to the constant-voltage circuits 250B, 250Y, 250M, and 250C. Also, connecting points of the individual resistors R1 to R4 with the constant-voltage circuits 250B, 250Y, 250M, and 250C are connected to individual A/D ports P1 to P4 provided at the control device 110 via signal lines, respectively. From the above, a voltage proportional to the magnitude of a current (each grid current Ig) which flows into each of the connecting lines L1 to L4 is input to each of the A/D ports P1 to P4. Therefore, the magnitude of the grid current Ig of each of the chargers 50B, 50Y, 50M, and 50C is detectable in the control device 110 by reading the level of the input voltage of each of the A/D ports P1 to P4.

The control device 110 controls the output of the voltage application circuit 200, and includes the PWM port A and the five A/D ports P1 to P5. The control device 110 can be constituted by a built-in CPU or can be constituted by an application specific integrated circuit (ASIC). The control device 110 has a nonvolatile storage unit (not shown) built therein, and makes various data (for example, the following data (a) to (d)) for executing an output control flow which will be described next stored in the nonvolatile storage unit.

(a) Data (250 μA) of reference value of grid current Ig
(b) Data (6 kV) of target value of output voltage Vo of voltage application circuit 200
(b) Data (7.5 kV) of upper limit of output voltage Vo of voltage application circuit 200
(d) Data (100 μA) of allowable value of current difference between grid currents Ig In addition, it is known that the grid current Ig is generally in a proportional relation to a discharge current which flows into the photosensitive drum 41 from the charger 50, and the grid current Ig becomes an index which plots the level of the discharge current which flows into the photosensitive drum 41. That is, if the grid current Ig flows as much as the reference value 250 μA, the discharge current which flows into the photosensitive drum 41 has the relation of exceeding a target level.

Figure 5A:
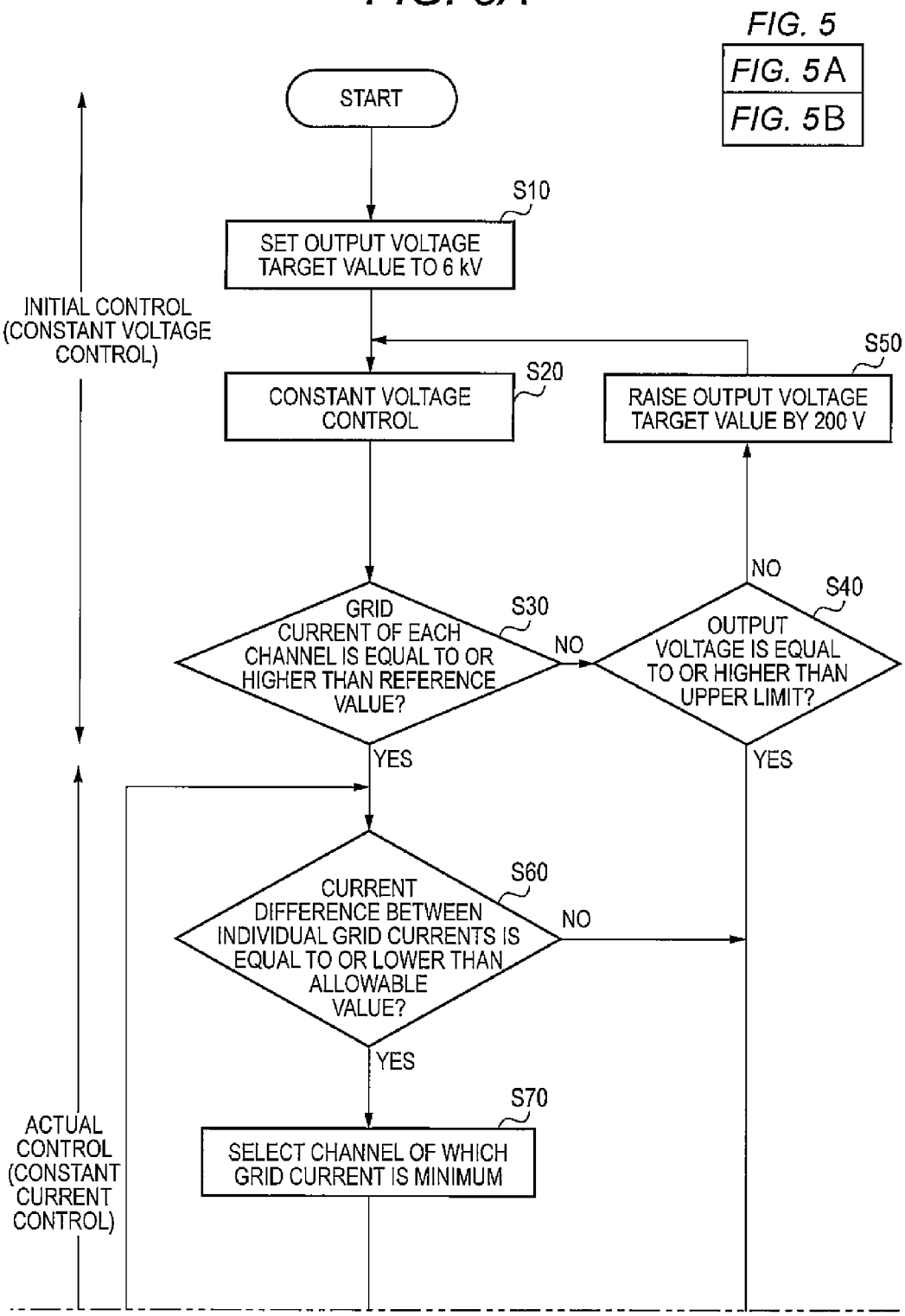
FIG. 5A and FIG. 5B are views showing an output control flow of a voltage application circuit.
Figure 5B:
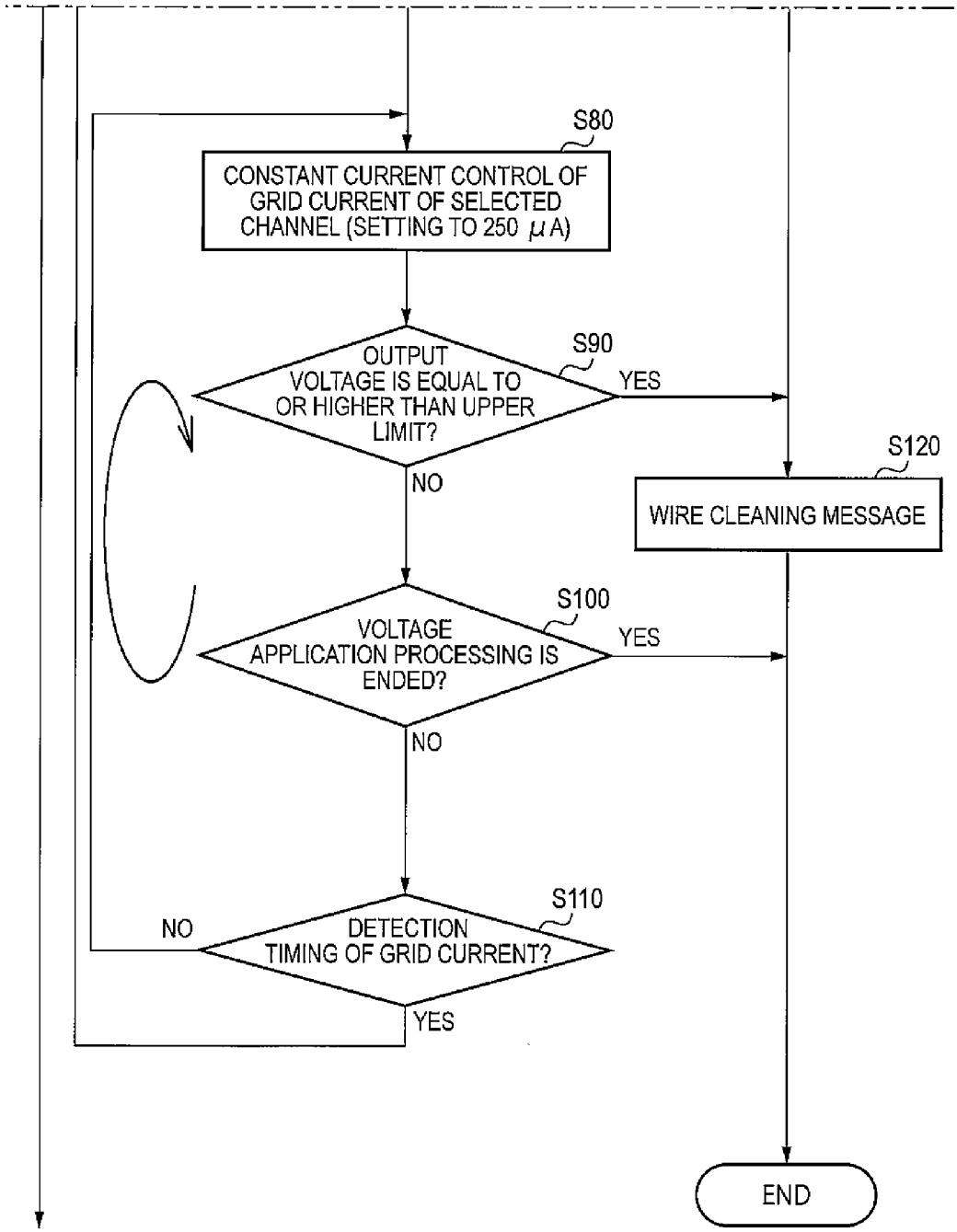

Next, the output control flow of the voltage application circuit 200 executed by the control device 110 will be described with reference to FIG. 5 (FIG. 5A and FIG. 5B). The output control flow of the present voltage application circuit 200 includes a two-step control of an initial control (constant voltage control: S10 to S50) which is executed immediately after the start of print processing, and an actual control (constant current control: S60 to S120) which is executed till the termination of the print processing after the initial control. Additionally, in the following description, it is supposed that individual channels CH indicate the individual chargers 50B, 50Y, 50M, and 50C.

(Initial Control: Constant Voltage Control)

As shown in FIG. 6, when the printing data is output from the higher-level device, the printing data is received in the printer 1 through the interface IF. Then, a printing processing start command is given to the control device 110 of the high-voltage power supply device 100 from the main controller 80. Thereby, the control device 110 starts the output control flow of FIG. 5, and sets the output voltage Vo of the voltage application circuit 200, i.e., the target value of an applied voltage applied to the wire 53 of each of the chargers 50B, 50Y, 50M, and 50C, to 6 kV (S10).

Next, the control device 110 performs a constant voltage control of the output voltage Vo in S20. The control device 110 adjusts the duty ratio of the PWM signal S1 on the basis of the input value (voltage value detected in the voltage detecting circuit 240) of the A/D port 5. Thereby, the primary voltage of the transformer Tr is controlled by the transformer driving circuit 220, and the output voltage Vo of the voltage application circuit 200 is adjusted to 6 kV which is the target value.

When the output voltage Vo is stabilized to "6 kV" which is the target value, then, the control device 110 calculates the current value of the grid current Ig of each channel CH from the input voltage of each of the A/D ports P1 to P4. Then, the grid current Ig of each channel CH is compared with the reference value, and the processing of determining whether or not the grid current Ig of each channel CH exceeds the reference value is performed (S30). Since the reference value is set to 250 μA in this example, in S30, it is determined whether or not the grid current Ig of each channel CH is equal to or higher than 250 μA.

If there is even one channel CH of which the grid current Ig falls below the reference value in the determination processing of S30, processing of S40 and S50 is performed in order in the control device 110. First, in S40, the processing of determining whether or not the output voltage Vo of the voltage application circuit 200 is equal to or higher than an upper limit is performed.

Such determination is provided in order to prevent the output voltage Vo from becoming too high. In this example, the upper limit of the output voltage Vo is set to "7.5 kV". If the output voltage Vo is smaller than the upper limit in S40, and then the processing of S50 is performed by the control device 110.

In S50, the processing of changing the target value of the output voltage Vo and raising the target value by 200 V is performed. Thereby, the target value of the applied voltage is changed to "6.2 kV" from "6 kV.

After that, as described previously, in S20, adjustment of the output voltage Vo of the voltage application circuit 200 is performed, and it is again determined in S30 whether or not the grid current Ig of each channel CH exceeds the reference value 250 μA.

Then, if all the grid currents Ig of the individual channels CH exceed the reference value 250 μA in S30, the initial control ends and the processing proceeds to the actual control after S60.

(Actual Control: Constant Current Control)

When the processing proceeds to the actual control, the control device 110 calculates the current value of the grid current Ig of each channel CH from the input voltage of each of the A/D ports P1 to P4. Then, the processing of calculating a current difference between a maximum value and a minimum value of the grid currents Ig of the individual channels CH, and determining whether or not the current difference falls within the allowable value "100 μA" is performed in S60. If the current difference is equal to or lower than the allowable value in S60, then the control device 110 proceeds to S70 where the current values of the grid currents Ig of the individual channels CH are compared with each other, and the channel CH of which the grid current Ig is the minimum (the minimum current value) is selected.

The magnitude of the grid current Ig of each channel CH basically depends on the degree of contamination of the wire of the charger 50. As the contamination becomes severer, the current value becomes smaller. The current value of a wire with no stain does not become small. This is because the magnitude the grid current Ig is proportional to the amount of electric discharge of the wire 53, and electric discharge of the wire 53 becomes difficult as the contamination becomes severer.

At this point, it will be made supposing that the printer 1 is in a state where printing is not nearly performed, and the wire 53 of each charger 50 is not contaminated. Therefore, the grid currents Ig of the individual channels CH become almost the same. Here, the following description will be made supposing that the grid current Ig of the first channel CH1 among the above channels, i.e., the grid current Ig of the charger 50B is the minimum.

Then, when selection of the channel CH is performed in S70, the control device 110 then performs a constant current control of the grid current Ig of the selected channel CH to the reference value 250 μA in S80. In this case, since the selected channel is the first channel CH1, the output voltage Vo of the voltage application circuit 200 is adjusted such that the grid current Ig of the channel CH1 becomes a constant current of the reference value of 250 μA. Specifically, the output power Vo is adjusted by adjusting the duty ratio of the PWM signal 51 output from the PWM port A on the basis of the input voltage of the A/D port P1.

If the constant current control is performed with the grid current Ig of the minimum current value being the reference value of 250 μA in this way, all the grid currents Ig of the remaining channels CH2 to CH4 become a current value which exceeds the reference value of 250 μA. Therefore, all the individual channels CH can pass a sufficient amount of discharge current to the individual photosensitive drums 41 from the individual chargers 50 side, and can make the charging amount of the individual photosensitive drums 41 equal to or higher than the target level. In addition, in this example, the constant current control is performed with the grid current Ig of the minimum current value being the reference value of 250 μA. However, the constant current control may be performed at the reference value or more. For example, the constant current control may be performed with the grid current Ig of the minimum current value being 270 μA.

Then, subsequent to S80, the processing of determining whether or not the output voltage Vo of the voltage application circuit 200 is equal to or higher than the upper limit "7.5 kV" is performed in S90. If the output voltage Vo falls below the upper limit value, processing of S100 is performed. In S100, the processing of determining whether or not the application processing of a high voltage to each of the chargers 50B, 50Y, 50M, and 50C has ended is performed. After the printer 1 ends the print processing, the control device 110 determines that the application processing of the high voltage has ended. Therefore, if it is determined that the application processing of the high voltage has ended in S100, a series of processing ends at once. Then, when the printing data output from the higher-level device 1000 is received again in the printer 1, a printing processing start command is given to the control device 110 of the high-voltage power supply device 100 from the main controller 80. Thereby, again, the processing is sequentially executed again from S10. In the actual control step, the output voltage Vo of the voltage application circuit 200 is controlled by the control device 110 such that the grid current Ig of a minimum current value becomes a constant current which is the reference value of 250 μA. On the other hand, if it is determined that the application processing of the high voltage has not ended in S100, the processing of determining whether or not the detection timing of the grid current Ig has been reached is executed in S110 in the control device 110.

In the present embodiment, the detection timing of the grid current Ig is fixed at every predetermined number of printing sheets (for example, every 100 sheets). Thus, it is determined in S110 that the detection timing of the grid current Ig has not been reached until the number of printing sheets reaches 100 sheets when numbered from a first printing page. Then, if it is determined in S110 that the detection timing of the grid current Ig has not been reached, the processing returns to S80. As a result, the processing of S80 to S110 is repeated until the number of printing sheets reaches 100 sheets. In addition, the detection timing of the grid current Ig may be fixed not to every predetermined number of printing sheets but to every predetermined time interval.

From the above, the output voltage Vo of the voltage application circuit 200 is adjusted in the control device 110 such that the grid current of a channel selected in S70, i.e., the channel CH1 becomes a constant value which is the reference value of 250 μA until the number of printing sheets reaches 100 sheets.

Then, if the number of printing sheets reaches 100 sheets, it is determined in S110 that the detection timing of the grid current Ig has been reached. In this case, the processing proceeds to S60. Then, the control device 110 calculates the current value of the grid current Ig of each channel CH again from the input value of each of the A/D ports P1 to P4. Then, the processing of calculating the current difference between the maximum value and the minimum value of the grid currents Ig of the individual channels CH, and determining whether or not the current difference falls within the allowable value is performed. Then, if the current difference is equal to or lower than the allowable value, the processing of selecting a channel CH of which the grid current Ig is the minimum is performed again in S70.

In S80, the output voltage Vo of the voltage application circuit 200 is adjusted by the control device 110 such that the grid current Ig of the newly selected channel CH becomes a constant value of 250 μA. This control state lasts until the next 100 sheets are printed.

Then, if the number of printing sheets reaches the next 100 sheets, the processing proceeds again to S60.

The reason why a control target channel for the constant current control is updated at every given time interval (the number of printing sheets is 100 sheets) is because it is assumed that the magnitude relation between the grid currents Ig of the individual channels CH varies with elapse of use of the printer 1. That is, if the printer 1 is used and the number of printing sheets increases, the wire 53 of each charger 50 is gradually contaminated. As described previously, the magnitude of the grid current Ig basically depends on the degree of contamination of the wire of the charger 50. As the contamination becomes severer, the current value of the grid current Ig becomes smaller.

In this regard, in the present embodiment, the current values of the individual grid currents Ig are compared with each other at every given time interval (the number of printing sheets is 100 sheets), and a channel CH of which the grid current Ig is the minimum is selected. Therefore, a channel CH in which contamination of the wire is the severest becomes the control target channel for the constant current control, and the grid current Ig of the channel CH concerned is controlled so as to be a current value which is equal to or greater than the reference value. Accordingly, it is possible to always control the grid currents Ig of all the channels CH so as to be equal to or higher than the reference value.

On the other hand, during the constant current control, the output voltage Vo of the voltage application circuit 200 tends to rise. This is because the grid current Ig decreases when the wire 53 is contaminated with use, and then, the control device 110 controls the level of the output voltage Vo of the voltage application circuit 200 in its raised direction in order to compensate for the decreased amount. If the output voltage Vo becomes too high, there is a possibility that the wire 53 of the charger 50 may cause abnormal electrical discharge.

In this regard, in the present embodiment, the processing of determining whether or not the output voltage Vo of the voltage application circuit 200 is equal to or higher than the upper limit is performed in S40 and S90. Then, if the output voltage exceeds the upper limit, the processing proceeds to S120 where the wire cleaning notification of prompting cleaning of the wire 53 of each charger 50 is notified. Specifically, the control device 110 makes a monitor (not shown) provided at the printer 1 display a message which prompts cleaning. Then, the processing related to the FIG. 5 ends once. In addition, when the output voltage exceeds the upper limit, the main controller 80 stops the printing operation of the printer 1 and the printing processing is halted. When the user dissolves the display message that recommends the wire cleaning, the main controller 80 restarts the printing operation of the printer 1 to restart the halted printing processing, and the control device 110 restarts the processing related to the FIG. 5 to execute an output control of the voltage application circuit 200.

If the message which prompts cleaning is made to display, an operator who has seen the message eliminates stains on the wire 53 of each charger 50 using a wire cleaner 57. Therefore, since normal electric discharge occurs easily in the wire 53 of each charger 50 after the elimination, it is possible to lower the output voltage Vo of the voltage application circuit 200, and the wire 53 of each charger 50 can be prevented from causing abnormal electrical discharge.

Additionally, for example, in a case where only the wire 53 of some chargers 50 is intensively contaminated, only the grid current Ig of the channel CH becomes small. Thus, the difference in the current values of the grid currents Ig between the channel CH becomes large. Then, it is determined that the current difference exceeds the allowable value when the determination processing of S60 is performed. Thereby, the processing proceeds to S120, and similarly to the above-described case, a wire cleaning notification of prompting cleaning of the wire 53 of each charger 50 is notified. Thereby, since an operator eliminates stains on the wire 53 of each charger 50 using the wire cleaner 57, a situation where the wires 53 of some chargers 50 are intensively contaminated can be overcome.

As described above, the printer 1 commonly uses the voltage application circuit 200 between the individual chargers 50B, 50Y, 50M, and 50C. Therefore, compared to a case where dedicated voltage application circuits 200 are provided at the individual chargers 50B, 50Y, 50M, and 50C, respectively, the number of parts can be reduced, and the benefit in terms of cost is high.

Moreover, the constant current control is performed with the grid current Ig of the minimum current value being a current value which is equal to or higher than the reference value. Accordingly, since it is possible to make the grid currents Ig of all the channels CH equal to or higher than the reference value, the amounts of charging of all the photosensitive drums 41B, 41Y, 41M, and 41C can be made equal to or higher than a target level. Therefore, deterioration of image quality through shortage of the charging amount is not caused.

Embodiment 2

Figure 7A:
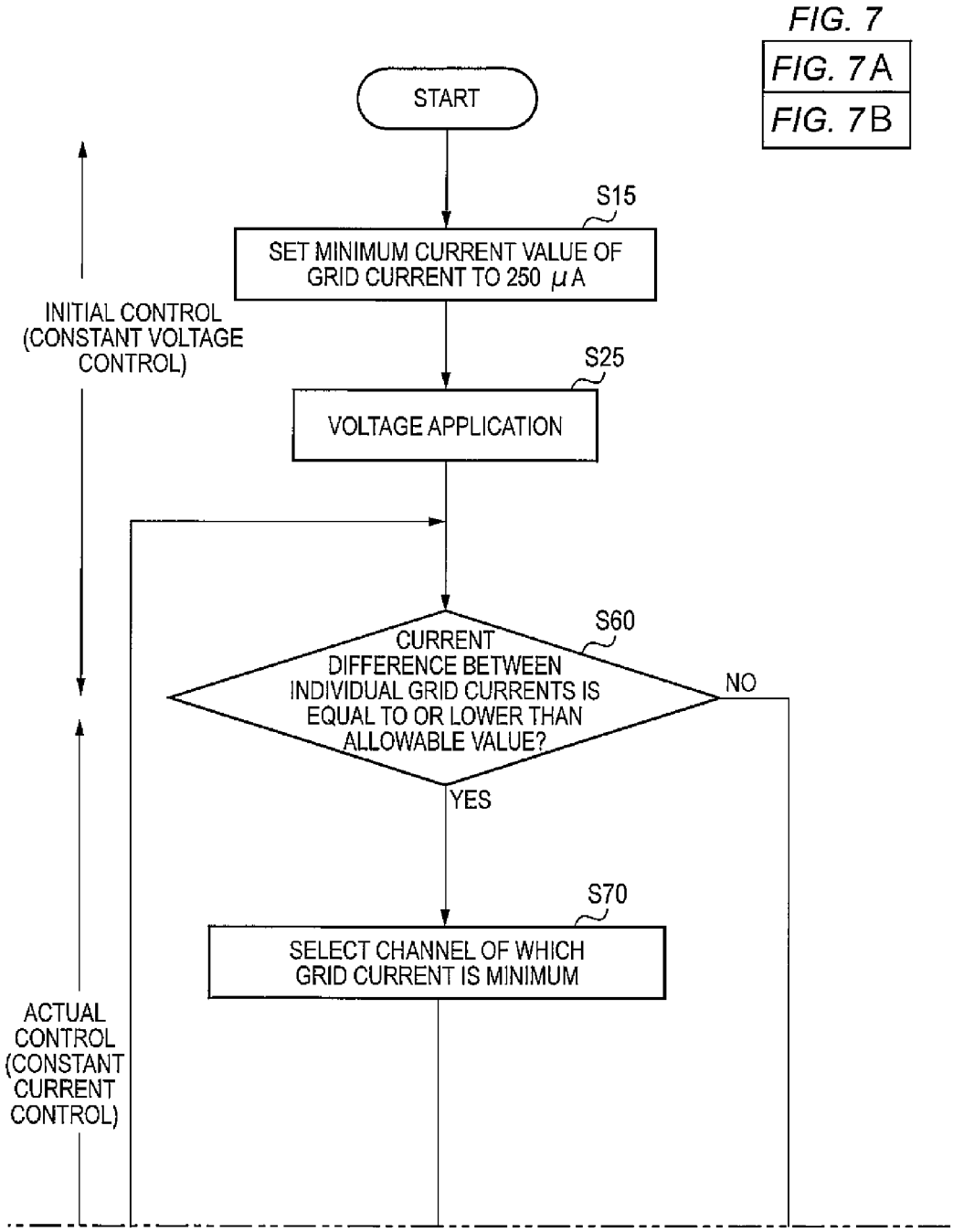
FIG. 7A and FIG. 7B are views showing an output control flow of a voltage application circuit in Embodiment 2.
Figure 7B:
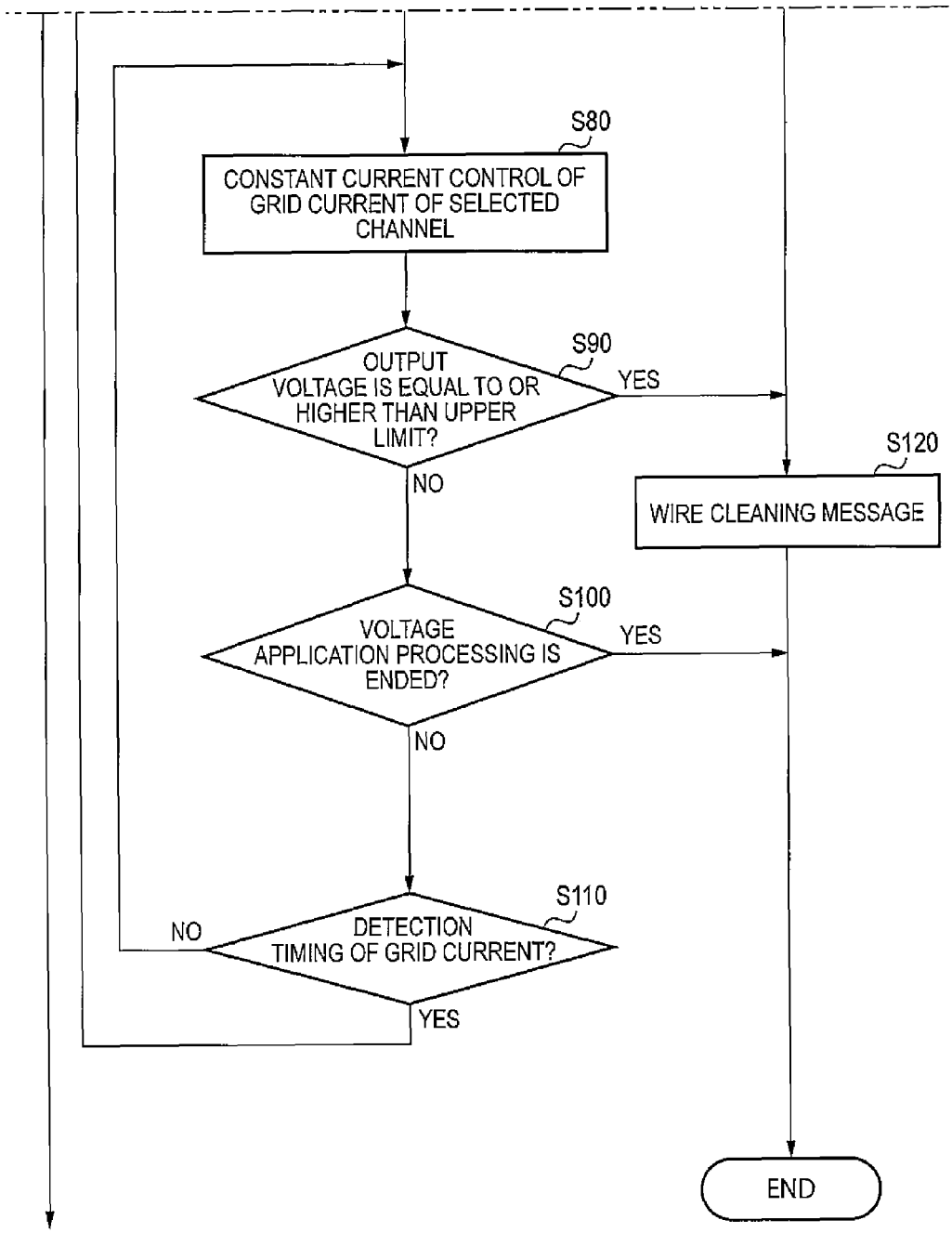

Embodiment 2 of the invention will be described with reference to FIG. 7 (FIG. 7A and FIG. 7B).

In Embodiment 1, the case where the constant voltage control is performed in the initial control, and the constant current control is performed in the actual control has been illustrated as the output control flow of the voltage application circuit 200 executed by the control device 110.

In Embodiment 2, the initial control is simplified in comparison to Embodiment 1. Specifically, the control device 110 sets the minimum current value (i.e., target current value) of the grid current Ig of each channel CH to 250 μA with start of the printing processing of the printer 1 (S15). Then, the control device 110 outputs the PWM signal S1 to the voltage application circuit 200, and applies a voltage to the wires 53 of the chargers 50B, 50Y, 50M, and 50C. Thereby, the initial control ends, and then, the processing proceeds to the actual control.

The control contents of the actual control are the same as those of Embodiment 1, and are composed of the processings of S60 to S120, and each processing is performed while conditional branch is performed. Thereby, the output voltage Vo of the voltage application circuit 200 is adjusted by the control device 110 such that the current value of the grid current Ig of the channel CH selected in S70 becomes a constant value of 250 μA set in S15. In addition, in the present embodiment, the target current value is set to 250 μA in S15. However, when the constant current control of the grid current Ig is performed in S80 as in Embodiment 1, the target current value may be set to 250 μA.

Therefore, since it is possible to make the grid currents Ig of all the channels CH equal to or higher than the reference value similarly to Embodiment 1, the amounts of charging of all the photosensitive drums 41B, 41Y, 41M, and 41C can be made equal to or higher than a target level. Therefore, deterioration of image quality by shortage of the charging amount is not caused. Additionally, in Embodiment 2, since the initial control is simplified, there is a benefit in that it is possible to terminate the time of the initial control in a short time.

Other Embodiments

The invention is not limited to the embodiments described by means of the above description and the drawings. For example, the following embodiments are also included within the technical range of the invention.

(1) In Embodiments 1 and 2, the constant current control is performed with the minimum grid current Ig being the reference value of 250 μA. This aimed at making the grid current Ig of each channel CH equal to or higher than the reference value of 250 μA. In order to make the grid current Ig of each channel CH equal to or higher than the reference value, it is also possible to perform a constant voltage control of the output voltage Vo of the voltage application circuit 200 other than the above constant current control. That is, a constant voltage control of the output voltage Vo may be performed at a voltage value such that a numerical value of the maximum grid current Ig exceeds the reference value.

(2) In Embodiments 1 and 2, the grid currents Ig of all the channels CH are detected altogether by providing the current detecting units 260B, 260Y, 260M and 260Y at the individual chargers 50B, 50Y, 50M, and 50C, respectively. This is done because whether the wire 53 of any charger 50 is apt to be contaminated cannot be specified. In a case where it can be expected that the wire 53 of a specific charger is apt to be contaminated, for example, from the positional relationship with a blower which fulfills a function to circulate the air around a charger i.e., in a case where the wire of a specific charger is apt to be contaminated owing to a factor that it is difficult to circulate air in a specific charger only, it is also possible to provide the current detecting unit 260 only at the connecting line L of the charger 50, and to perform the constant current control of the grid current Ig of the charger 50.

Figure 8A:
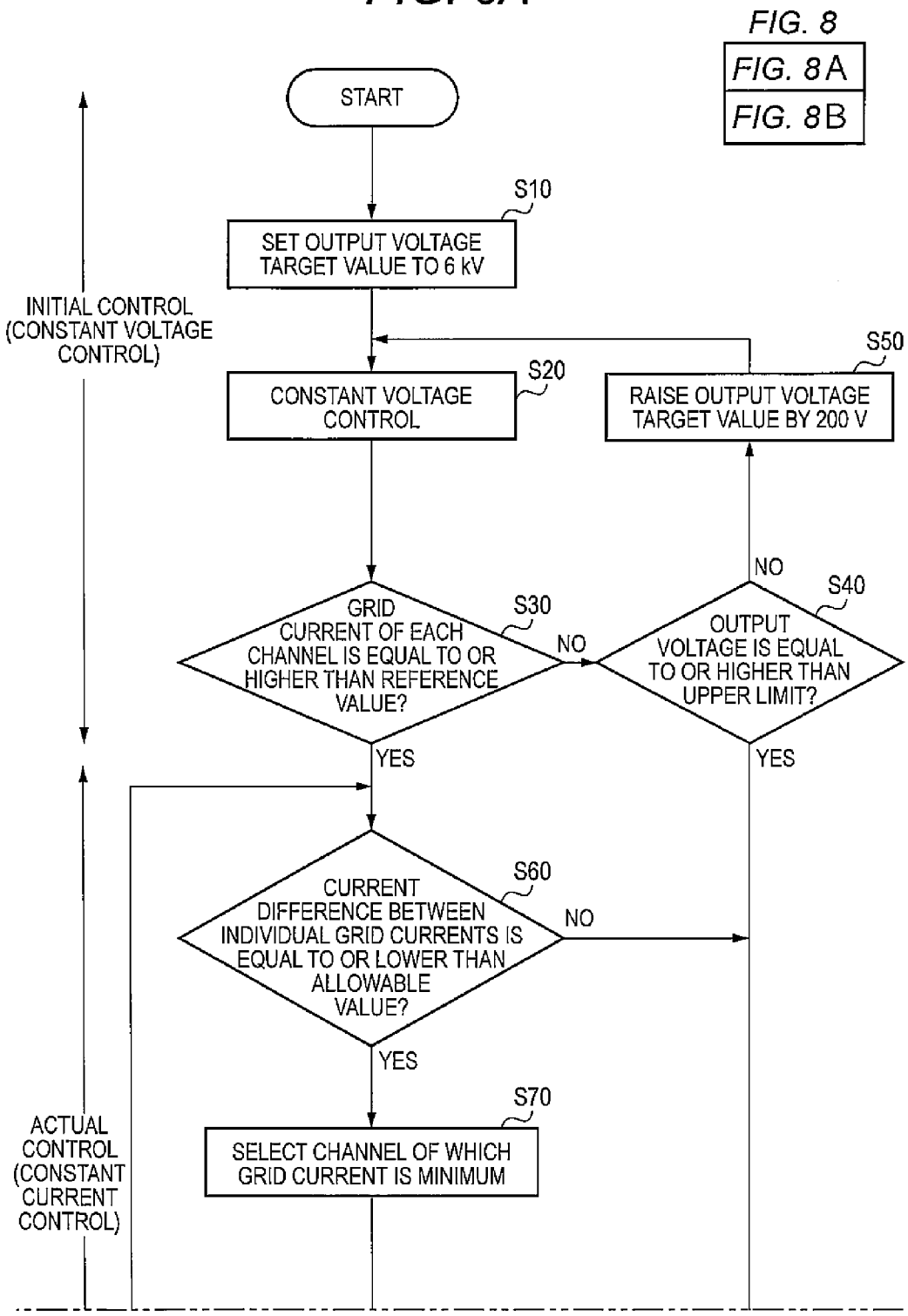
FIG. 8A and FIG. 8B are views showing a modification of the output control flow of the voltage application circuit.
Figure 8B:
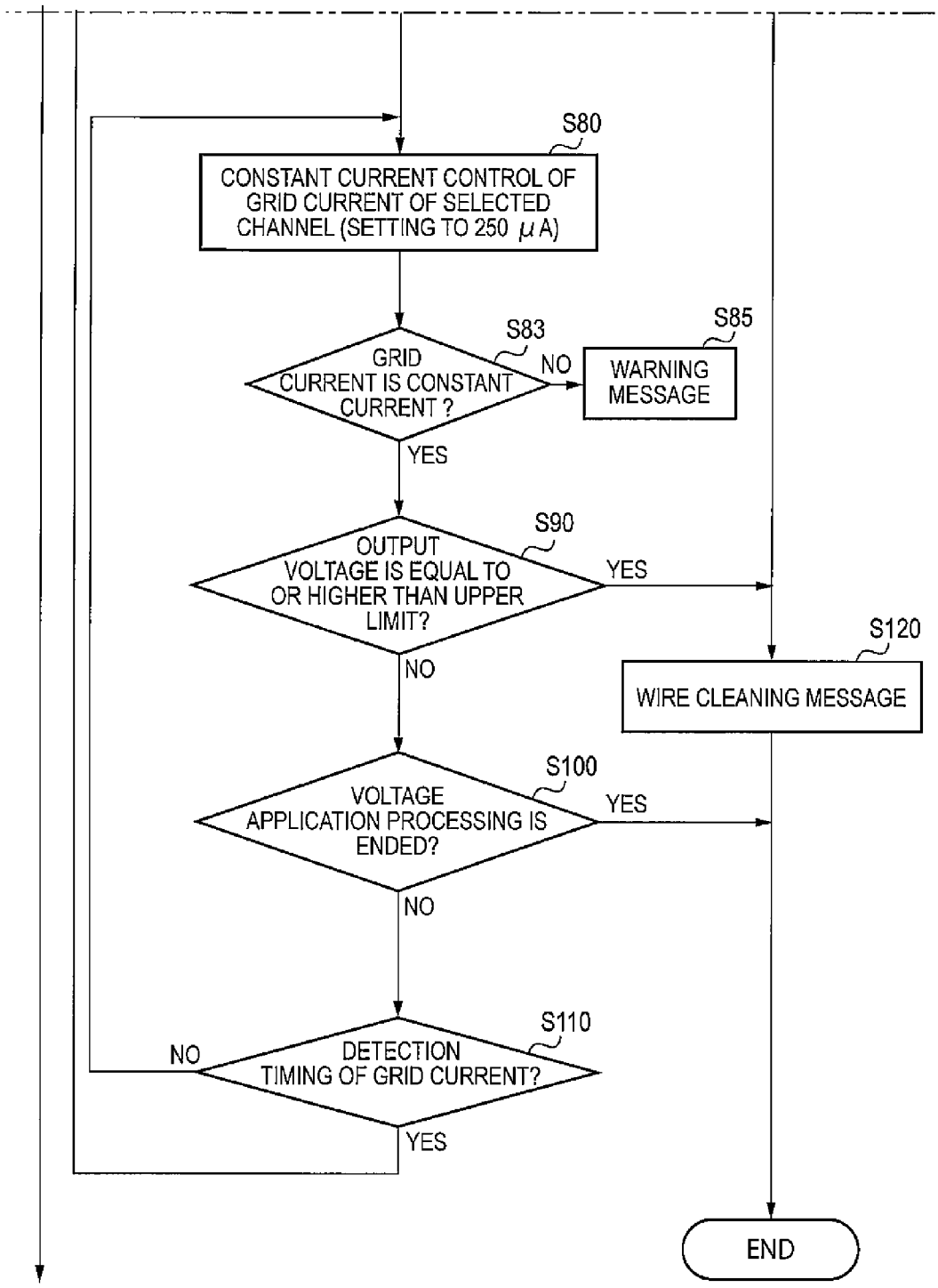

(3) Additionally, as shown in FIG. 8 (FIG. 8A and FIG. 8B), when the processing of S83 and processing of S85 are added to the output control flow of Embodiment 1, and a state where the grid current Ig of a channel which is a control target does not becomes a constant current, it is preferable that the control device 110 make a monitor (not shown) provided at the printer 1 display a warning message which warns of the occurrence of an abnormality. By doing so, it is possible to notify an operator of the abnormality of a circuit early.

Figure 9:
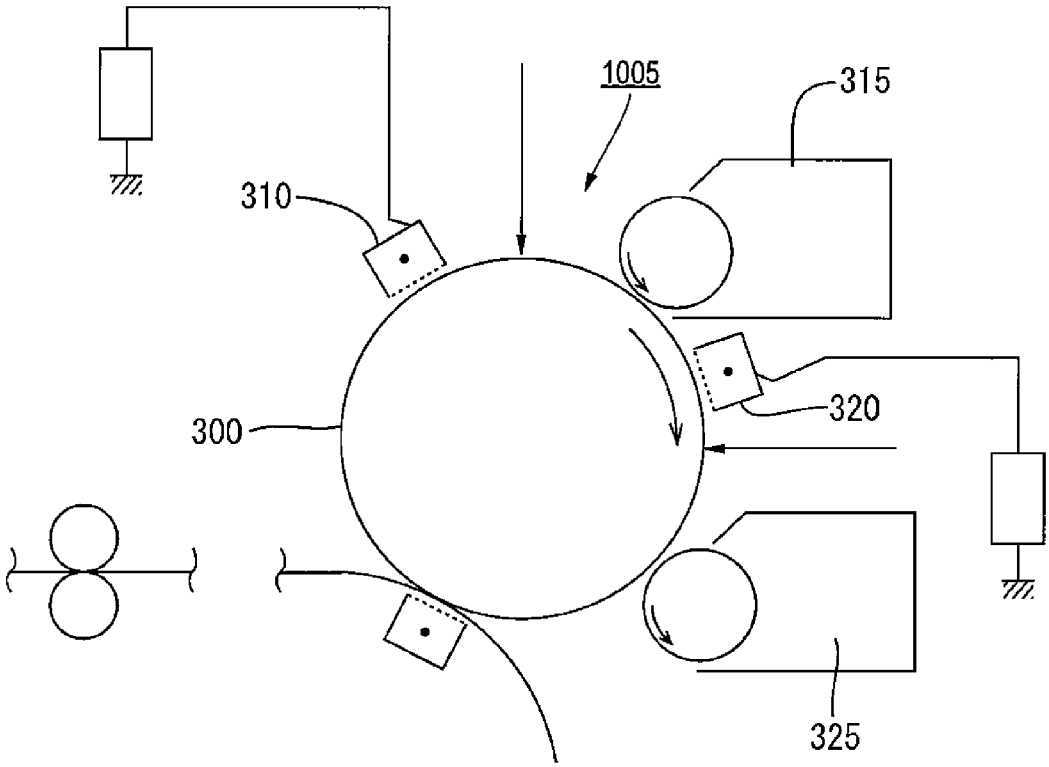
FIG. 9 is a view showing other configurations of an image forming unit.

(4) In Embodiments 1 and 2, the image forming unit 5 in which one charger 50 is made to correspond to one photosensitive drum 41 (in other words, a photosensitive drum 41 is provided for each color) is illustrated as an example of the configuration of the image forming unit. The invention can also be applied to, for example, an image forming unit 1005 in which a plurality of chargers 310 and 320 is arranged to correspond to one photosensitive drum 300 as shown in FIG. 9 (the image forming unit 1005 in which toner images for individual colors are collectively transferred to a sheet after being superimposed on the photosensitive drum 300), in addition to the printer 1 having the configuration mentioned in Embodiments 1 and 2. In addition, reference numeral 315 in FIG. 9 designates a process unit (developing unit) which makes a set with the charger 310, and reference numeral 325 designates a process unit which makes a set with the charger 320.

(5) Additionally, it is also possible to perform the output control flow of the voltage application circuit 200 of FIG. 5 described in Embodiment 1 as follows. When a series of processing is ended with the end of the voltage application processing, the control device 110 makes the data of a channel CH selected at the time of the end and the data of number of printing sheets stored in a storage unit. Then, when the printing data is received again in the printer 1 and the output control flow is performed again, the data is read and processing is started from Step 80. Thereby, after the return, the constant current control is performed with the grid current of a channel CH selected just before the end being 250 μA, and the number of sheets printed after the return is counted so as to be added to a previous number of sheets. By doing it in this way, the output control flow of the voltage application circuit 200 can be resumed in the form of taking over the previous state.

(6) In Embodiments 1 to 2, the zener diodes are illustrated as an example of the constant voltage elements. However, it is possible to use varistors in addition to this. Additionally, a resistance detection type is illustrated as an example of the current detecting unit 260. However, it is possible to use a current sensor using a hall element in addition to this.

In addition, in Embodiments 1 to 2, the LED, which is arranged in one row along the direction of the rotational axis of the photosensitive drum, is used to form an electrostatic latent image on the surface of the photosensitive drum. However, a laser light source can be used to form the electrostatic latent image on the surface of the photosensitive drum.

What is claimed is:

1. An image forming apparatus comprising:

a plurality of photosensitive drums;

a plurality of scorotron chargers provided for the plurality of photosensitive drums, respectively, the plurality of scorotron chargers configured to charge the photosensitive drums, respectively;

a voltage application circuit commonly connected to the plurality of scorotron chargers, the voltage application circuit configured to apply voltages to the plurality of scorotron chargers;

a plurality of wires provided for the plurality of scorotron chargers, respectively;

a plurality of grid electrodes provided for the plurality of scorotron chargers, respectively;

a plurality of current detecting units provided for the plurality of grid electrodes, respectively, the current detecting units configured to detect grid current flowing into the grid electrodes, respectively; and a control device configured to:

determine a minimum current value from the detected grid currents, and control the voltage application circuit such that a grid current of the minimum current value becomes a constant current equal to or higher than a reference value.

2. The image forming apparatus according to claim 1, wherein the control device is configured to determine the minimum current value from the grid currents for every predetermined number of printing sheets, and to control the voltage application circuit such that the grid current determined to have the minimum current value becomes the constant current which is equal to or higher than the reference value.

3. The image forming apparatus according to claim 1, further comprising:

a voltage detecting circuit configured to detect an output voltage of the voltage application circuit, the output voltage to be applied to the scorotron chargers, wherein, the control device is further configured to execute, when the output voltage detected in the voltage detecting circuit has exceeded an upper limit, a process of notifying wire cleaning which prompts cleaning of the wires.

4. The image forming apparatus according to claim 1, wherein the control device is further configured to execute a process of notifying an abnormality when the grid current of the minimum current value cannot be controlled to the constant current which is equal to or higher than the reference value.

5. The image forming apparatus according to claim 1, wherein the control device is further configured to execute a process of notifying wire cleaning, which prompts cleaning of the wires, when a current difference between two different grid currents become equal to or higher than a predetermined value.

6. An image forming apparatus comprising:

a photosensitive drum;

a plurality of scorotron chargers provided for the photosensitive drum, the plurality of scorotron chargers configured to charge the photosensitive drum;

a voltage application circuit commonly connected to the plurality of scorotron chargers, the voltage application circuit configured to apply voltages to the plurality of scorotron chargers;

a plurality of wires provided for the plurality of scorotron chargers, respectively;

a plurality of grid electrodes provided for the plurality of scorotron chargers, respectively;

a plurality of current detecting units provided for the plurality of grid electrodes, respectively, the current detecting units configured to detect grid current which flowing into the grid electrodes, respectively; and a control device configured to:

determine a minimum current value from the detected grid currents, and control the voltage application circuit such that a grid current of the minimum current value becomes a constant current equal to or higher than a reference value.

7. The image forming apparatus according to claim 6, wherein the control device is configured to determine the minimum current value from the grid currents for every predetermined number of printing sheets, and to control the voltage application circuit such that the grid current determine to have the minimum current value becomes the constant current which is equal to or higher than the reference value.

8. The image forming apparatus according to claim 6, further comprising:

a voltage detecting circuit configured to detect an output voltage of the voltage application circuit, the output voltage to be applied to the scorotron chargers, wherein the control device is configured to execute, when the output voltage detected in the voltage detecting circuit has exceeded an upper limit, a process of notifying wire cleaning which prompts cleaning of the wires.

9. The image forming apparatus according to claim 6, wherein the control device is configured to execute a process of notifying an abnormality when the grid current of the minimum current value cannot be controlled to the constant current which is equal to or higher than the reference value.

10. The image forming apparatus according to claim 6, wherein the control device is configured to execute a process of notifying wire cleaning, which prompts cleaning of the wires, when a current difference between two different grid currents become equal to or higher than a predetermined value.

11. A method comprising:

controlling a grid current flowing into a plurality of grid electrodes provided for a plurality of scorotron chargers, respectively, the plurality of scorotron chargers configured to charge a plurality of photosensitive drums, respectively, wherein controlling the grid current includes controlling a voltage application circuit, commonly connected to the plurality of scorotron chargers, such that a grid current flowing into a grid electrode of a specific scorotron charger becomes equal to or higher than a predetermined value, wherein the specific scorotron charger includes a wire that is apt to be contaminated.

12. A method comprising:

controlling a grid current which flows into a plurality of grid electrodes provided for a plurality of scorotron chargers, respectively, the plurality of scorotron chargers configured to charge a photosensitive drum, wherein controlling the grid current includes controlling a voltage application circuit commonly connected to the plurality of scorotron chargers such that a grid current flowing into a grid electrode of a specific scorotron charger becomes equal to or higher than a predetermined value, wherein the specific scorotron charger includes a wire that is apt to be contaminated.

* * * * *